US008403628B2

(12) United States Patent
Koza et al.

(10) Patent No.: US 8,403,628 B2
(45) Date of Patent: Mar. 26, 2013

(54) LOW-PRESSURE STEAM TURBINE HOOD AND INNER CASING SUPPORTED ON CURB FOUNDATION

(75) Inventors: Kenneth M. Koza, Ballston Lake, NY (US); Daniel R. Predmore, Ballston Lake, NY (US); Edward J. Sharrow, Scotia, NY (US); Raymond K. Overbaugh, Jr., Berne, NY (US); Robert J. Sherwood, Fonda, NY (US)

(73) Assignee: General Electric Company, Schenectady, NY (US)

( * ) Notice: Subject to any disclaimer, the term of this patent is extended or adjusted under 35 U.S.C. 154(b) by 632 days.

(21) Appl. No.: 12/639,582

(22) Filed: Dec. 16, 2009

(65) Prior Publication Data

US 2011/0142605 A1 Jun. 16, 2011

(51) Int. Cl.
*F01D 25/24* (2006.01)
*F01D 25/28* (2006.01)

(52) U.S. Cl. ..... 415/108; 415/213.1

(58) Field of Classification Search ..... 415/108, 415/213.1, 214.1, 229, 230
See application file for complete search history.

(56) References Cited

U.S. PATENT DOCUMENTS 3,520,634 A * 7/1970 Meylan et al. ..... 415/134
3,594,095 A * 7/1971 Trassel et al. ..... 415/60
3,843,281 A 10/1974 Meylan et al.
3,881,843 A 5/1975 Meylan
3,892,500 A * 7/1975 Miller et al. ..... 415/213.1
3,920,251 A * 11/1975 Remberg ..... 277/416
4,413,948 A * 11/1983 Purr ..... 415/213.1
4,744,726 A 5/1988 Remberg

FOREIGN PATENT DOCUMENTS

EP 0213297 B1 3/1989
GB 1217557 A 12/1970
JP 11093616 A * 4/1999

OTHER PUBLICATIONS

GB Search Report issued in connection with corresponding GB Application No. 1020572.2, Mar. 29, 2011.

* cited by examiner

*Primary Examiner* — Edward Look
*Assistant Examiner* — Jesse Prager
(74) *Attorney, Agent, or Firm* — Cantor Colburn LLP

(57) ABSTRACT

A support arrangement for an exhaust hood. The inner casing in the inventive arrangement is supported directly by the curb foundation. As a result, the effect of pressure changes in the exhaust hood are eliminated and the effect of temperature changes of the exhaust hood are reduced relative to the positioning of the inner casing and the rotor within it. Shaft bearings may be outside the exhaust hood located in a standard directly on the foundation. Rotor end packing may also be attached to the standard. The exhaust hood can be a much simpler design with less structural supports and less fabrication time. Easier maintenance is facilitated because the shaft bearings are not tucked under the exhaust hood and the end packing can be removed without removal of a large section of the exhaust hood.

15 Claims, 7 Drawing Sheets

LOW-PRESSURE STEAM TURBINE HOOD AND INNER CASING SUPPORTED ON CURB FOUNDATION

BACKGROUND OF THE INVENTION

The invention relates generally to steam turbines and more specifically to a support structure for a low-pressure steam turbine.

The outer shell of a steam turbine low-pressure section is generally called the exhaust hood. The primary function of an exhaust hood is to divert the steam from the last stage bucket of an inner shell to the condenser with minimal pressure loss. Usually the lower half of the exhaust hood supports an inner casing of the steam turbine and also acts as a supporting structure for the rotor. The upper exhaust hood is usually a cover to guide the steam to the lower half of the hood. The hood for large double-flow low-pressure steam turbines is of substantial dimensions and weight and usually is assembled only in the field. In many steam turbines, the inner case of the steam turbine, for example a double flow/down exhaust unit has an encompassing exhaust hood split vertically and extending along opposite sides and ends of the turbine. This large, box-like structure houses the entire low-pressure section of the turbine. The exhaust steam outlet from the turbine is generally conically-shaped and the steam exhaust is redirected from a generally axial extending flow direction to a flow direction 90 degrees relative to the axial flow direction. This 90-degree flow direction may be in any plane, downwardly, upwardly or transversely. Thus the exhaust hoods for steam turbines constitute a large rectilinear structure at the exit end of the conical section for turning and diffusing the steam flow at right angles.

The lower half of the exhaust hood, split horizontally from the upper half, directs the exhaust flow of steam to a condenser usually located generally beneath the exhaust hood. The lower exhaust hood typically supports the inner casing of the turbine and the associated steam path parts such as diaphragms and the like. The lower exhaust hood is further loaded by an external pressure gradient between atmospheric pressure on the outside and near-vacuum conditions internally. The lower exhaust hood shell is generally of fabricated construction with carbon-steel plates. Typical sidewalls for the lower exhaust hood are flat and vertically oriented. To provide resistance to the inward deflection of the sidewalls under vacuum loading, the lower exhaust hood traditionally has included internal transverse and longitudinal plates and struts. These internal transverse and longitudinal plates and struts form a web, generally underneath the turbine casing and extending to the sidewalls.

FIG. 1 illustrates typical arrangements of a low-pressure double-flow steam turbine 5 with an exhaust hood. An exhaust hood 10 includes an upper exhaust hood 15 and a lower exhaust hood 20, mating at a horizontal joint 22. An inner casing 25 is supported at multiple supporting pads (not shown) on the lower exhaust hood 20. To distribute the load from these pads to an external foundation (not shown) for the low-pressure turbine, various supporting structures are present in the form of transverse plates 35 and struts 40. These transverse plates 35 avoid the suction effect of the sidewalls 45 and end walls 50 and they distribute the load applied on the hood due to loads on inner casing 25. The lower exhaust hood 20 further provides a support location for shaft seals (not shown) and end bearings (not shown) for the turbine rotor (not shown). The lower exhaust hood may include a framework 70 including support ledges 75 that may rest on the external foundation. The sidewalls 45 and end walls 50 may be constructed of flat metal plates, joined at seams by welding or other known joining methods. Steam inlets 30 penetrate each transverse side of the exhaust hood 10. Bearing housings GO for the turbine rotor (not shown) are provided at axial ends of the exhaust hood 10.

The internal hood stiffeners and flow plates are costly. Further, the thick-walled plate used for the sidewalls is also costly. Prior attempts to stiffen exhaust hoods have focused on different combinations of internal stiffeners (pipe struts, plates) and wall thicknesses so as to avoid excess deflection. The problem is that to control the side and end wall deflections of the hood, transverse plates and stiffeners are required inside of the hood. The existence of these transverse and struts increases the complexity of the hood, increases the weight of the hood and creates aero blockages resulting in aero performance losses.

Another distinct adverse impact of the conventional arrangement is the effect of vacuum within the exhaust hood on the steam turbine operation. A vacuum is, of course, required in the operation of a low-pressure steam turbine to extract maximum work from the unit. However, in a conventional exhaust hood, the bearings are located in the cone areas and the inner casing supports are located inside the lower hood. When the exhaust hood is under vacuum, the inner walls and end cones deflect causing misalignment of the steam path rotor parts, end packing and bearing movements/tilt. The extended walls of the lower exhaust hood also support the inner exhaust casing in the conventional arrangement. The extended walls include hood footplates and supporting gussets. The height of the extended wall may be nearly 5 feet. Temperature and pressure changes in the hood will alter the position of the inner casing being supported by the hood wall, thereby impacting clearances of the rotor relative to the end bearings and the leakage labyrinths.

Accordingly, it would be desirable to provide a support structure for a low-pressure steam turbine that reduces operating misalignment between the rotor and the stationary members and at the same time reduce structural complexity, cost, and obstruction to aerodynamic performance.

BRIEF DESCRIPTION OF THE INVENTION

According to a first aspect of the present invention, a support structure is provided for a low-pressure steam turbine including a turbine rotor, an internal casing and an exhaust hood. The support structure includes an external foundation surrounding the low-pressure steam turbine. An exhaust hood for the low-pressure steam turbine is provided including an upper exhaust hood and a lower exhaust hood, each mating at a horizontal joint flange. The horizontal joint flange for the lower exhaust hood is supported on the external foundation. Multiple support arms for the internal casing extend over the external foundation. There is at least one pedestal standard mounted to the external foundation and adapted for supporting the turbine rotor.

According to another aspect of the present invention, a low-pressure steam turbine is provided. The low-pressure steam turbine includes an inner casing, a turbine rotor, and an exhaust hood. The exhaust hood includes an upper exhaust hood and a lower exhaust hood, each mating at a horizontal joint flange. An external foundation for the low-pressure steam turbine includes a curb foundation. One or more pedestal standards are mounted to the external foundation and adapted for supporting the turbine rotor. Multiple support arms for the internal casing support the internal casing directly from the external curb foundation.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The present invention includes a support arrangement for an exhaust hood and inner casing of a low-pressure turbine on a curb foundation. The following embodiments of the present invention have many advantages. One distinct advantage is the elimination of the adverse affects of vacuum within the exhaust hood on the steam turbine operation. In a conventional exhaust hood, the bearings are located in the cone areas and the inner casing supports are located in the hood. When the exhaust hood is under vacuum, the inner walls and end cones deflect causing misalignment of the steam path rotor parts, end packing and bearing movements/tilt. Because the inner casing in the inventive arrangement is supported directly by a curb foundation, the effects of temperature and pressure changes of the exhaust hood are eliminated relative to the positioning of the inner casing and the rotor within it. The shall bearings for the low-pressure turbine may be outside the exhaust hood located in a standard, which is supported directly on the foundation. The rotor end packing may also be attached to the standard. The arrangements will provide a lower overall cost product since the exhaust hood can be a much simpler design with less structural supports and less fabrication time. Use of the curb foundation for direct support of the inner casing allows eliminating footplates and gussets in the lower hood, reducing materials, and complexity and fabrication time, thereby cost. Easier maintenance is facilitated because the shaft hearings are not tucked under the exhaust hood and the end packing can be removed without removal of a large section of the exhaust hood. Supports are not required for the bearing cone area and inside the hood to support the inner casing. Better aerodynamic performance for the exhaust hood can be obtained from the less complex and obstructive hood arrangement in the exhaust flow path. The inventive arrangement further incorporates a more robust design since the major steam path components are now supported directly on a foundation. This will allow use of tighter clearances resulting in a better performing turbine due to less leakage.

Figure 2:
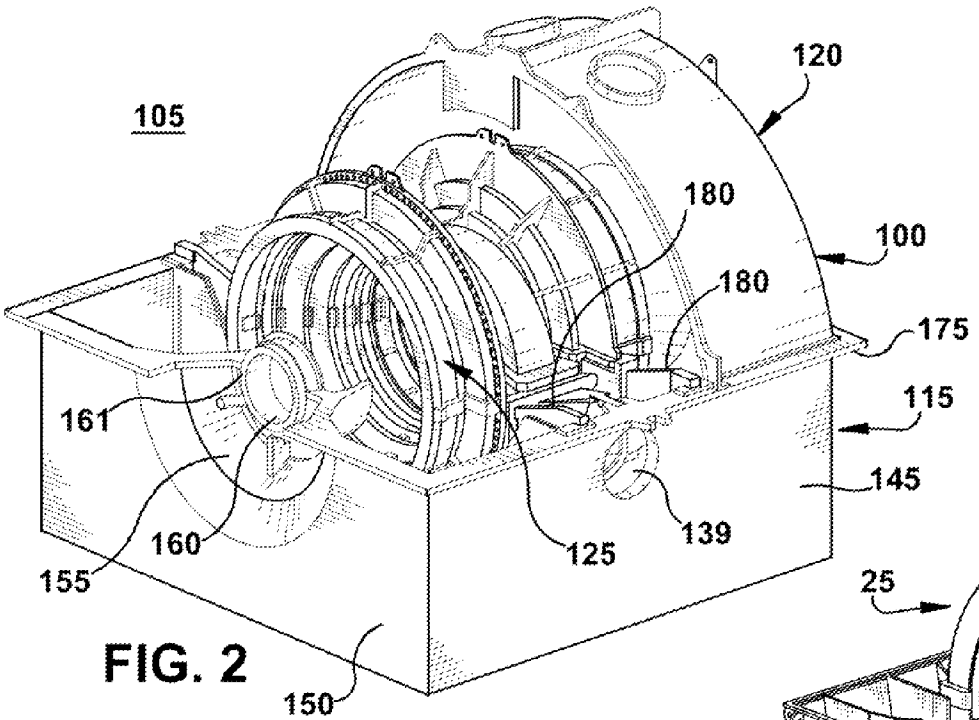
FIG. 2 illustrates an embodiment of a low-pressure steam turbine with an inventive support arrangement.

FIG. 2 illustrates an isometric cutaway view of an inventive support arrangement for a low-pressure turbine 105 including inner casing 125 and exhaust hood 110. The exhaust hood 110 includes a lower exhaust hood 115 and an upper, exhaust hood 120 (cutaway). The inner casing 125 is shown without a rotor shaft for clarity purposes. Sidewalls 145 and endwalls 150 of a lower exhaust hood 115 extend upward to a mounting flange 175 adapted for resting on a curb foundation (not shown). A generally circular penetration 139 (one shown) is provided on each axial sidewall 145 for a double steam inlet (second steam inlet not shown) to the inner casing 125. An expanded conical recess 155 is provided on each axial end wall 150. The conical recess 155 includes semicircular penetrations 161 on the lower exhaust hood 115 and upper exhaust hood 120, adapted for mounting an outer end seal housing 160 for the exhaust hood.

Figure 3:
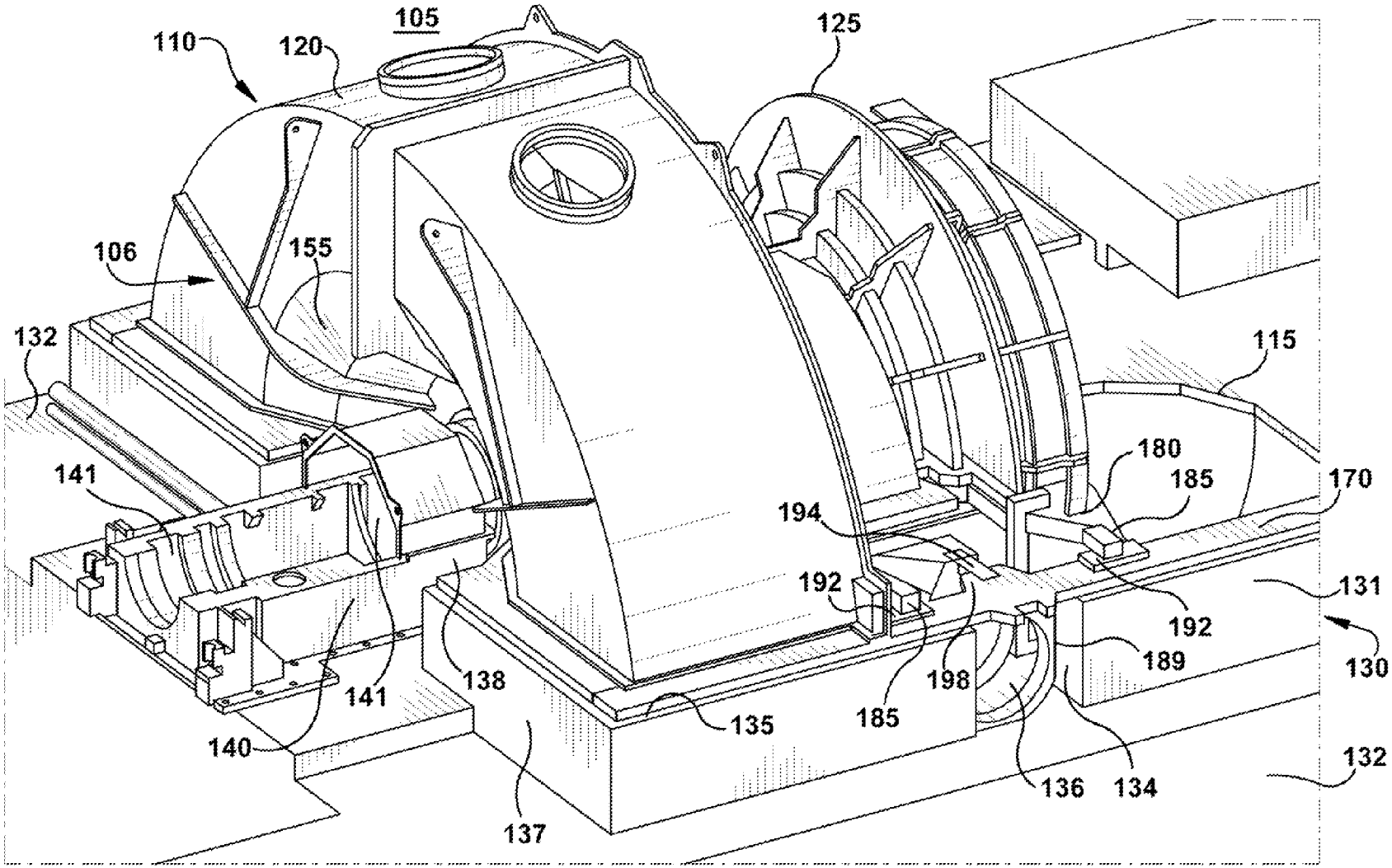
FIG. 3 illustrates an isometric view of the supporting foundation for an embodiment of the inventive low-pressure steam turbine.

FIG. 3 illustrates an isometric view of the supporting foundation for the inventive low-pressure steam turbine. The curb foundation 130 surrounds the exhaust hood 110 for the low-pressure steam turbine 105. The curb foundation 130 may be built up as a wall 131 from the underlying foundation 132. The curb foundation 130 may be comprised of reinforced concrete or other suitable support material for the turbine load. The horizontal joint flange 170 for the lower exhaust hood 115 rests directly on a top surface 135 of the curb wall 131. The curb wall 131 may include an opening 134 on each axial side to accept steam-line penetration 136 to opposing sides of the inner casing 125. At each axial end 137, the curb wall 131 may include an end opening 138 for mounting of a pedestal standard 140. The underlying foundation 132 may extend beyond the axial ends 106 of the exhaust hood to provide support for turbomachinery (not shown), such a high or intermediate pressure steam turbine or an electrical generator, rotatingly connected to the low-pressure steam turbine.

The pedestal standards 140 may be mounted to the underlying foundation 132 for the low-pressure turbine at axial ends 106 of the exhaust hood 110. Mounting for the pedestal standards 140 may extend axially through the curb foundation 130 into the conical recess 155 of the exhaust hood. Each pedestal standard 140 may include housings 141 for a journal and a thrust bearing (bearings not shown). The pedestal standard 140 may further include mounting for include an inner end seal housing (not shown).

Figure 4:
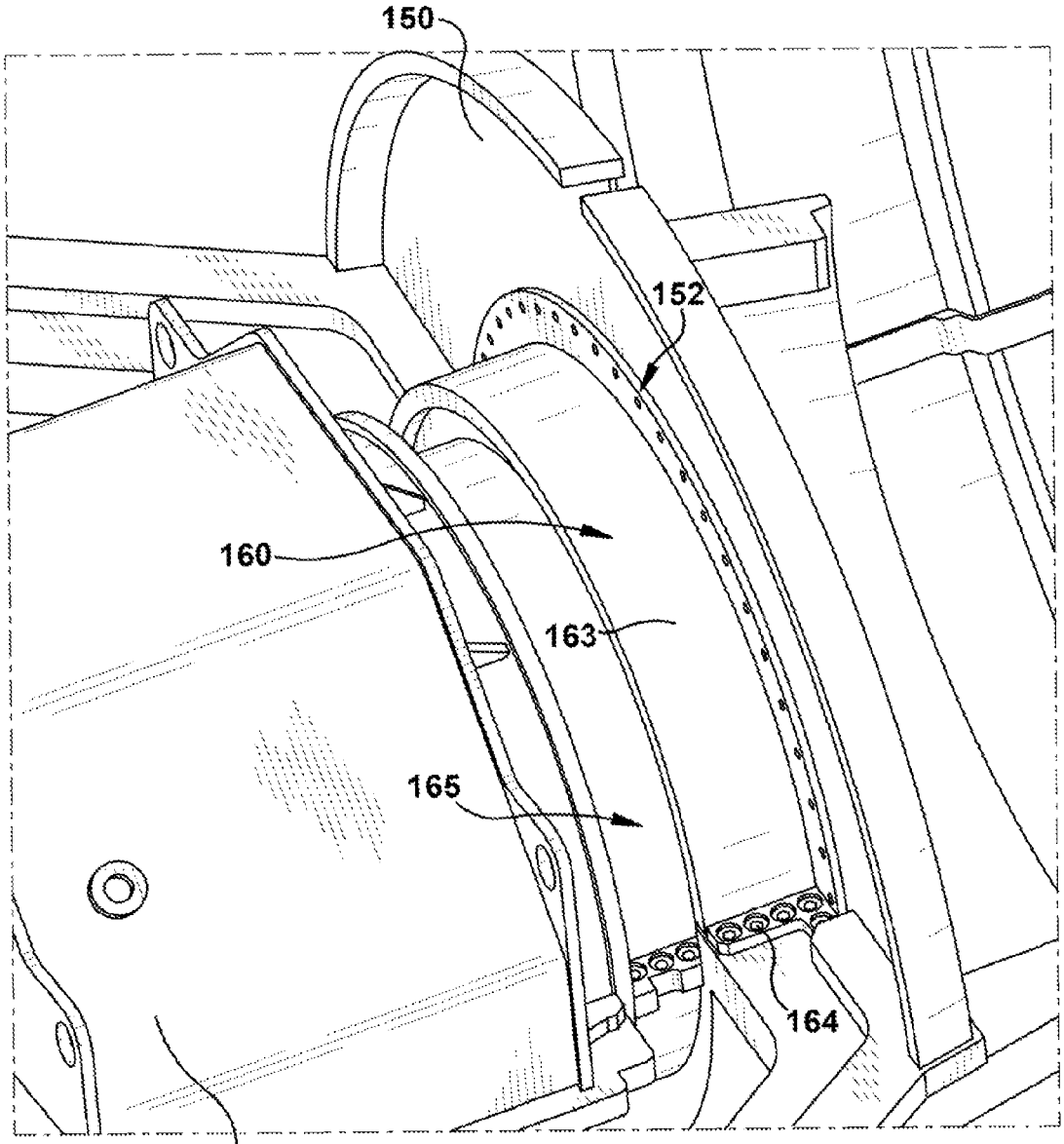
FIG. 4 illustrates an external isometric view of an end seal arrangement for an embodiment of the inventive low-pressure turbine support arrangement.
Figure 5:
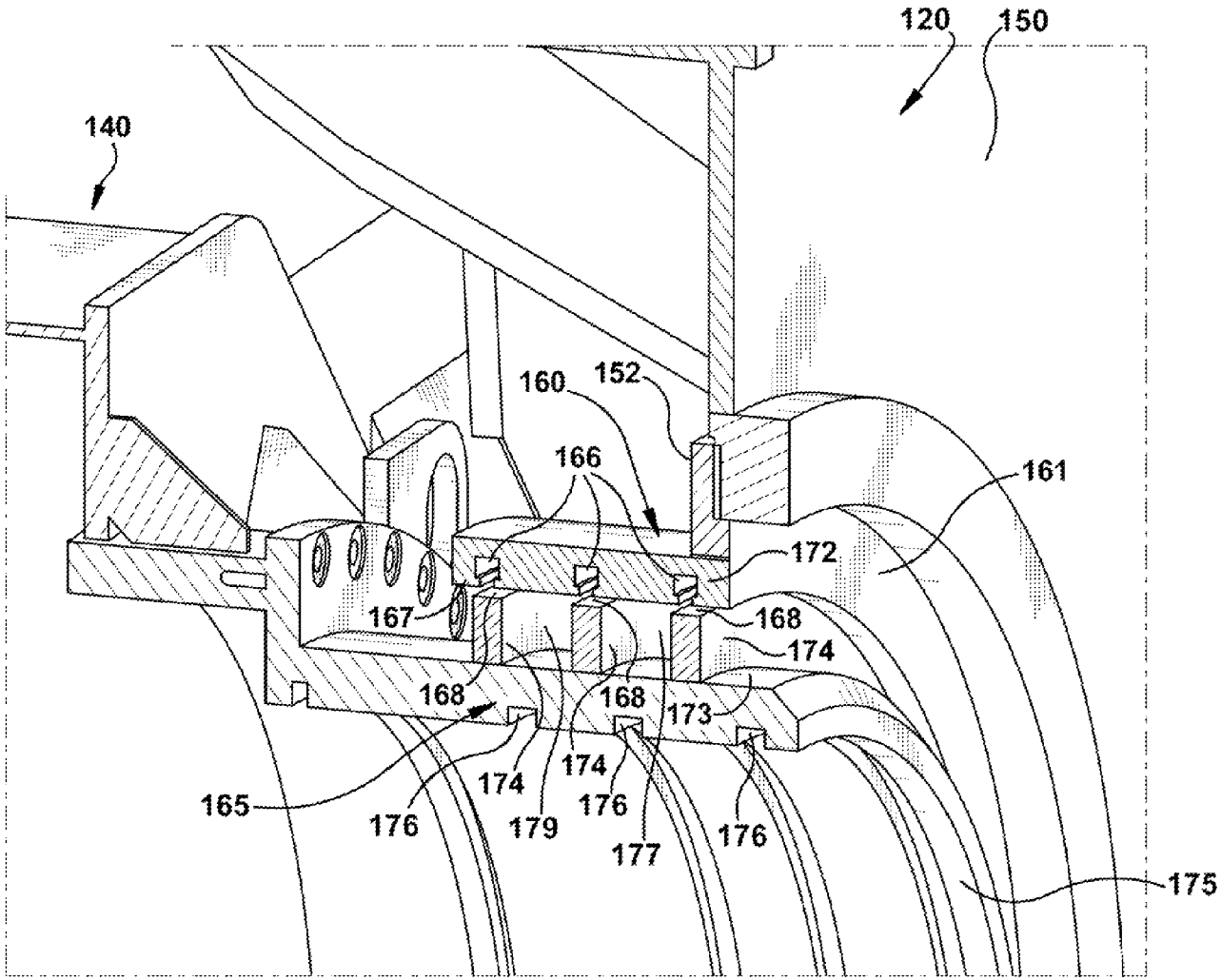
FIG. 5 illustrates a cutaway view of the end seal arrangement for an embodiment of the inventive low-pressure turbine support arrangement.

FIG. 4 illustrates an external isometric cutaway view of an end seal arrangement for the inventive low-pressure turbine support arrangement. FIG. 5 illustrates an cutaway view of the end seal arrangement. The outer end seal housing 160 is formed in the shape of a split-collar and includes an inner axial cavity 161. A lower half (not shown) of the outer end seal housing may be fixedly mounted to the lower exhaust hood (not shown). An upper half 163 of the outer end seal housing may be attachedly mounted to the upper exhaust hood 120. The upper half 163 may be bolted with a peripheral flange 152 to the endwall 150 of the upper exhaust hood 120. The upper half and lower half of the outer end seal housing 160 may be joined at a horizontal bolting flange 164. An inner end seal housing 165 is slidingly insertable into the inner axial cavity 161 of the outer end seal housing 160 and adapted for mounting to the pedestal standard 140. Multiple circumferential seal grooves 166 are provided axially along an inner surface 167 of the outer end seal housing 160 at locations corresponding to seal surfaces 168 of an inner end seal housing 165. Fixed packing seals (not shown) may be seated within the seal grooves 166 of internal axial cavity 161 of the upper half 172 of the outer end seal housing 160. Packing seals (not shown) of the lower half (not shown) may be slidably removable from the respective seal grooves (not shown) to facilitate seal replacement without the need to remove the lower half housing itself.

The inner end seal housing 165 includes an upper inner seal housing and a lower inner seal housing. The upper and lower halves may be supported by bolting or other usual means to the pedestal standard 140. An outer axial surface 173 of the inner end seal housing 165 may include radially extended annular buildups 174 that are axially positioned to provide the sealing surfaces 168 for the packing seals (not shown) of the outer end seal housing. An inner axial surface 175 of the inner end seal housing 165 may be provided with multiple circumferential seal grooves 176 for accepting seal packing (not shown) for the turbine rotor shaft (not shown). Labyrinth seal piping and vent piping are also provided to cavities 177 and 179 respectively, to aid in sealing.

Figure 6:
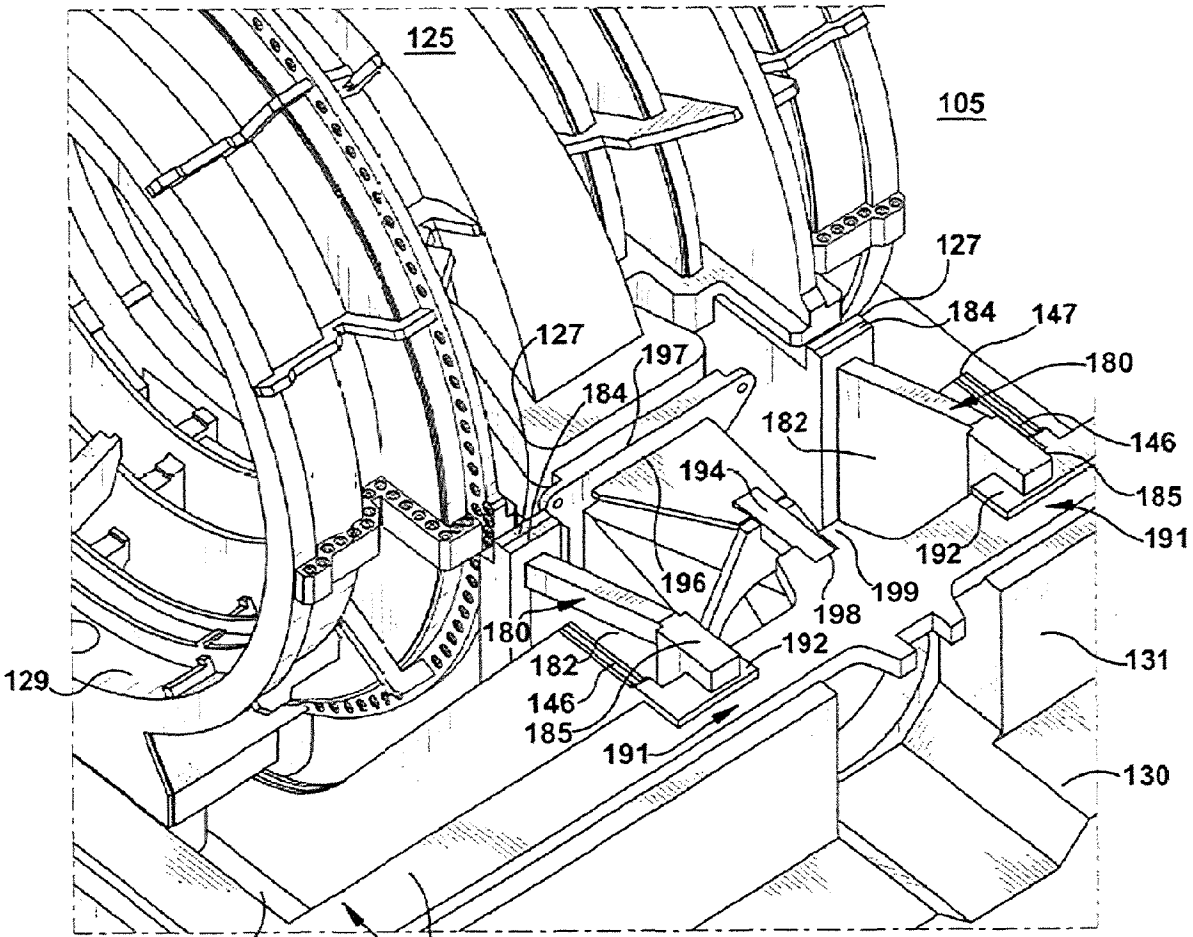
FIG. 6 illustrates an isometric view of inner casing support arrangements for an embodiment of the inventive low-pressure turbine support arrangement.
Figure 7:
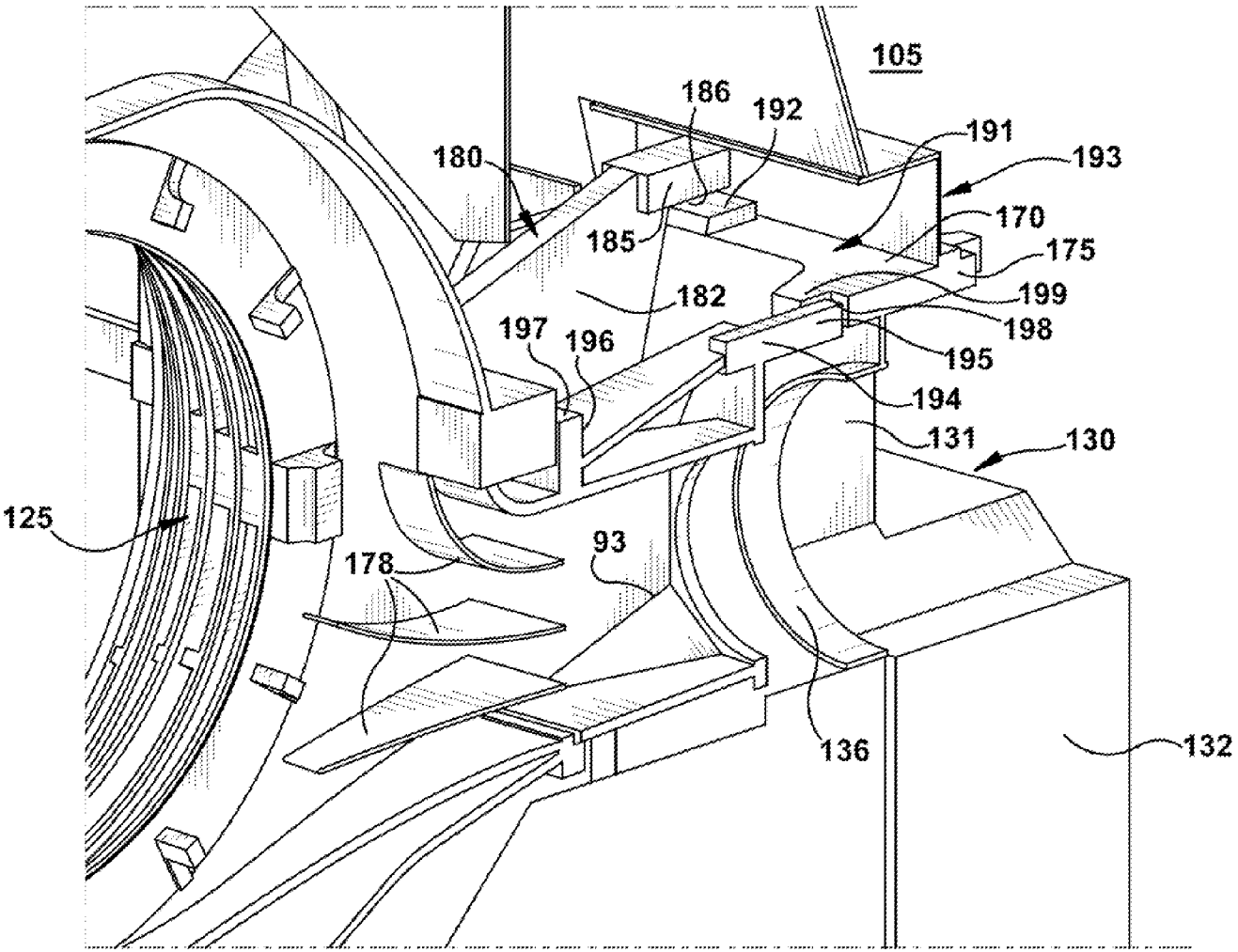
FIG. 7 illustrates an isometric sectional view of an embodiment for the inventive support arrangement for the low-pressure turbine.
Figure 8:
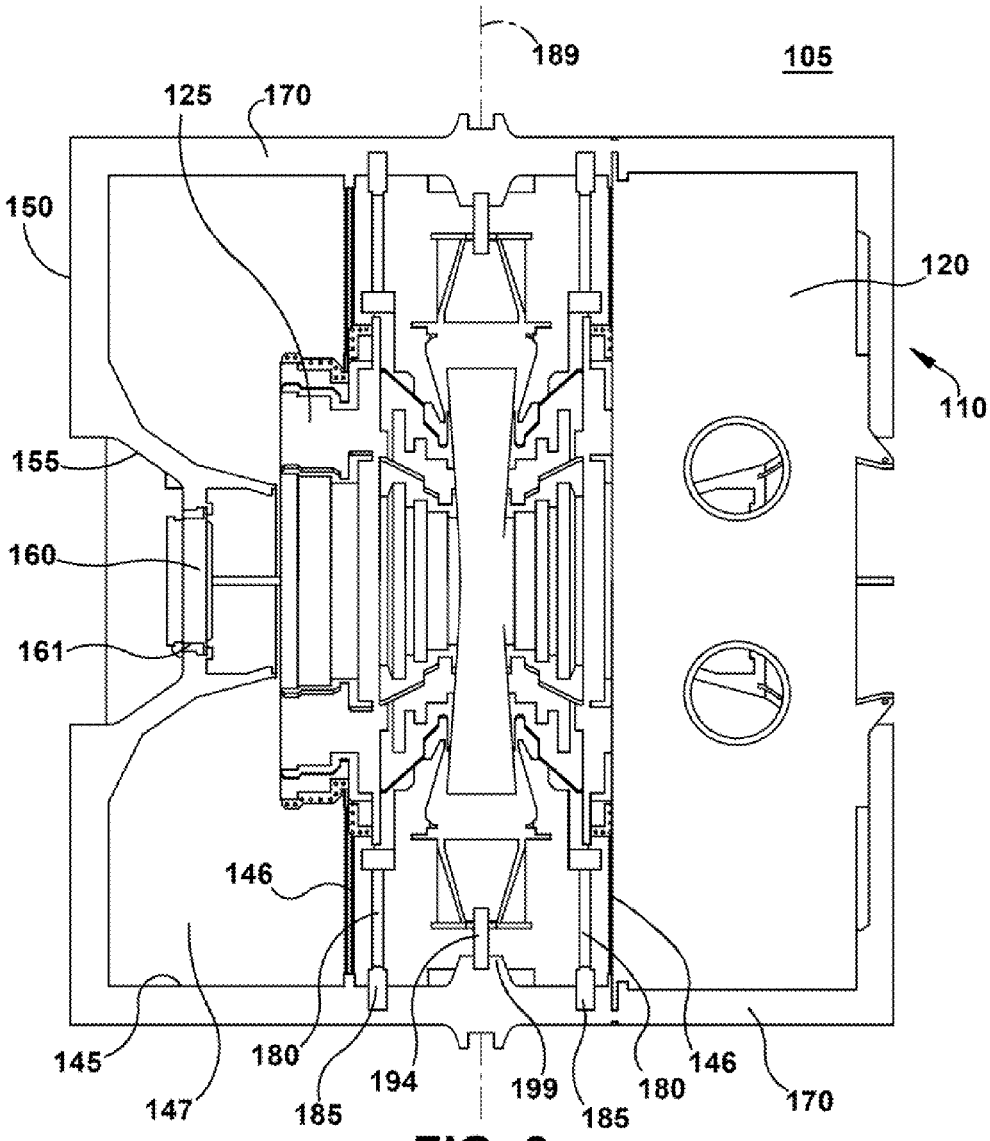
FIG. 8 illustrates a top cutaway view of an embodiment for the support arrangement for the low-pressure turbine.

FIG. 6 illustrates an isometric view of support arrangements for the inner casing of the low-pressure turbine. FIG. 7 illustrates an isometric sectional view of the inner casing support arrangement. FIG. 8 illustrates a top cutaway view of the support arrangement for the low-pressure turbine. Two support arms 180 on each axial side of the inner casing 125 of the low-pressure turbine 105 carry the load of the inner casing to the curb wall 131. Each support arm 180 may be fixedly mounted to the internal casing 125. Each support arm 180 may be disposed approximately equidistant from the axial centerline.

The underside of each support arm 180 may further include a support web 182. An inboard end of the support arm 180 and the support web 182 may also include a support flange 184. The support flange 184 may be vertically oriented and align, with a corresponding inner flange 127 mounted to the inner casing 125. The support arm 180, through the inner flange 127 may attach to the inner casing 125 by bolting or other known means at the lower half 129 of the inner casing 125. An outer radial end of the support arm 180 may include a pad section 185. The pad section is horizontally disposed, the underside 186 of which may be supported by the curb wall 131.

The horizontal joint surface 170 of the lower exhaust hood 115 may include a support area 191. The support area 191 is adapted to provide support for one the support arms 180. The support area 191 is directly supported by the curb wall 131 below, but not through the sidewalls 145 (FIG. 2) and endwalls 150 (FIG. 2) of the lower exhaust hood 115 as with other prior art exhaust hoods. Because the sidewalls 145 and endwalls 150 of the lower exhaust hood 115 are not required to support the weight of the inner casing 125, it need not be strengthened for that purpose. The positioning of the inner casing 125 and hence the clearance to the turbine rotor is not impacted by the effect of changing exhaust pressure within the exhaust hood 110. Further, the effect of internal hood temperature on clearance to the rotor is substantially reduced.

The support area 191 on the horizontal joint flange 170 of the lower exhaust hood may further include raised planar surfaces 192 configured to receive the underside 186 of the pad sections 185 of the support arms 180. The raised planar surfaces 192 may be fabricated to properly align with the underside 186 of the pad sections 185 of the support arms 180, eliminating the need for such matching machining of the entire horizontal joint flange 170.

Because the pad section 185 of the support arms 180 rests above the horizontal joint flange 170 of the lower exhaust hood 115, a normally configured horizontal joint flange of the upper exhaust hood cannot provide closure in this area with the lower exhaust hood 115. An expanded cover section 193 of the upper exhaust hood 120 is provided for the support areas 191 on each side of the exhaust hood 110. The expanded cover section 193 on each side is adapted to enclose and seal the support area 191 between the lower exhaust hood 115 and upper exhaust hood 120 upon which the pad section 185 of each support arm 180 rests.

Steam inlet penetration 93 directs inlet steam through internal flow guide vanes 178 inside inner casing 125. A centering arm 194 is disposed on each transverse side of the inner casing 125. An outer radial end 195 of the centering arm 194 is supported axially at the horizontal joint flange 170 of the lower exhaust hood 115. An inner radial end 196 of the centering arm 194 is supported by a mounting bracket 197 fixed on a transverse side of the inner casing 125. The centering arm 194 fixes the position of the internal casing 125 relative to an axial midpoint 189. The centering arm 194 may insert into a groove 198 within a centering bracket 199 on the horizontal joint flange 170.

Figure 1:
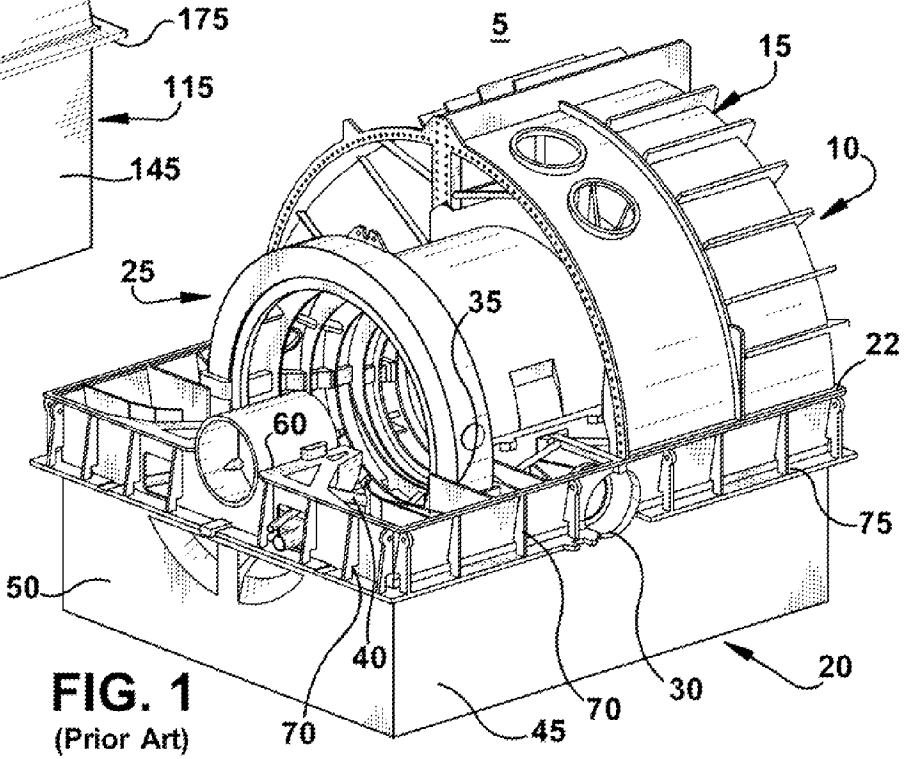
FIG. 1 (Prior Art)
FIG. 1 illustrates typical arrangements of a low-pressure steam turbine with an exhaust hood.

A vertical joint 146 for the lower exhaust hood 115 may be provided in proximity to each support arm 180, usually disposed axially outboard from the respective support arm. The vertical joint 146 may extend from one sidewall 145 (FIG. 1) to the opposite sidewall 145. Because the sidewalls 145 and end walls 150 of the lower exhaust hood 115 do not support the inner casing 125, the inventive support arrangement may not require further additional transverse and axial webs and struts as provided in conventional support arrangements (FIG. 1). The large annular exhaust path area 147 from axially outboard from the areas of the support arms 180 to the endwalls 150 is largely unobstructed. Further, the extension of this annular area 147 under the inner casing 125 is also largely unobstructed. The elimination of the obstructions in the exhaust path results in direct aerodynamic improvements for the exhaust hood 110.

While various embodiments are described herein, it will be appreciated from the specification that various combinations of elements, variations or improvements therein may be made, and are within the scope of the invention.

The invention claimed is:

1. A support structure for a low-pressure steam turbine including a turbine rotor, an internal casing and an exhaust hood, the support structure comprising:

an external foundation surrounding the low-pressure steam turbine;

the exhaust hood for the low-pressure steam turbine; the exhaust hood including an upper exhaust hood and a lower exhaust hood, the upper exhaust hood and the lower exhaust hood each including a mating horizontal joint flange;

a curb foundation extending upwardly from the external foundation;

the horizontal joint flange for the lower exhaust hood supported directly on the curb foundation;

a plurality of support arms for the internal casing, the plurality of support arms being supported over the curb foundation and comprising at least two support arms fixedly mounted to each side of the internal casing and disposed approximately equidistant from the axial centerline of the internal casing;

a plurality of support areas of the mating horizontal joint flange of the lower exhaust hood, each support area being adapted for one of the plurality of support arms, wherein each of the support areas is directly supported by the curb foundation below;

a lower surface on an outer end of each of the plurality of support arms, the lower surface being adapted to rest on a corresponding support area of the mating horizontal joint flange of the lower exhaust hood;

an outer end seal housing mounted at each axial end of the exhaust hood, the outer end seal housing including an inner axial cavity;

a lower section of the outer end seal housing fixedly mounted to the lower exhaust hood;

an upper section of the outer end seal housing attachedly mounted to the upper exhaust hood;

fixed seals within the internal axial cavity of the upper section and the lower section, the fixed seals of the lower section being slidably removable from seal grooves of the lower half of the outer seal end housing; and at least one pedestal standard mounted to the external foundation and adapted for supporting the turbine rotor.

2. The support structure according to claim 1, wherein each support arm of the plurality of support arms for the internal casing further comprises a support web on an underside of the support arm.

3. The support structure according to claim 1, further comprising:

an elevated planar surface relative to the horizontal joint flange of the lower exhaust hood, the underside of the support arms disposed upon the elevated planar surface; and an expanded cover area of the upper exhaust hood, the expanded cover area adapted to enclose and seal the support area between the upper exhaust hood and lower exhaust hood upon which the outer end of each support arm rests.

4. The support structure according to claim 1, further comprising:

a plurality of centering arms, one centering arm disposed on each transverse side of the inner casing, wherein an outboard end of the centering arm is fixedly mounted to a centrally disposed fixture on the horizontal casing flange of the lower exhaust hood and the inner end of the centering arm is fixedly mounted to an axial midpoint of the inner casing.

5. The support structure according to claim 1, further comprising:

an inner end seal housing slidingly insertable into the inner axial cavity of the outer end seal and adapted for mounting to the pedestal standard, wherein the inner seal housing includes raised sealing surfaces on an outer radial surface adapted to accept the fixed seals of the outer end seal housing and a plurality of seals on an inner radial surface adapted to seal a rotating surface on the turbine rotor;

a first cavity disposed radially between the inner end seal housing and the outer end seal housing and further disposed axially between circumferential buildup rings at an outer end of inner seal housing, and fluidly connected to a source of sealing steam; and a second cavity disposed radially between the inner end seal housing and the outer end seal housing and further disposed axially between circumferential buildup rings inboard axially from the first cavity, and fluidly connected to a vent sink.

6. The support structure according to claim 3, further comprising:

a journal disposed at least at one end of a shaft of the rotor, wherein the journal is rotatingly supported by a journal bearing mounted within the at least one pedestal standard.

7. A low-pressure steam turbine comprising:

an inner casing;

a turbine rotor;

an exhaust hood including an upper exhaust hood and a lower exhaust hood, the upper exhaust hood and the lower exhaust hood each including a mating horizontal joint flange;

an external foundation for the low-pressure steam turbine;

a curb foundation extending upwardly from the external foundation;

the horizontal joint flange for the lower exhaust hood supported directly on the curb foundation;

at least one pedestal standard mounted to the external foundation and adapted for supporting the turbine rotor;

an outer end seal housing mounted to the exhaust hood; the outer end seal including an inner axial cavity;

a lower section of the outer end seal housing fixedly mounted to the lower exhaust hood;

an upper section of the outer end seal housing attachedly mounted to the upper exhaust hood;

fixed seals within the internal axial cavity of the upper section and the lower section, the fixed seals of the lower section being slidably removable from seal grooves of the lower half of the outer seal end housing;

an inner end seal housing slidingly insertable into the inner axial cavity of the outer end seal and adapted for mounting to the pedestal standard, wherein the inner seal housing includes raised sealing surfaces on an outer radial surface adapted to accept the fixed seals of the outer end seal housing and a plurality of seals on an inner radial surface adapted to seal a rotating surface on the turbine rotor; and a plurality of support arms for the internal casing, the plurality of support arms supporting the internal casing directly from the curb foundation.

8. The low-pressure steam turbine according to claim 7, the plurality of support arms comprising:

at least two support arms fixedly mounted to each side of the internal casing and disposed approximately equidistant from and at opposing sides of an axial centerline of the internal casing.

9. The support structure according to claim 8, wherein each support arm of the plurality of support arms for the internal casing further comprises a support web on an underside of the support arm.

10. The low-pressure steam turbine according to claim 8, further comprising:

a plurality of support areas of the mating horizontal joint flange of the lower exhaust hood, each support area being adapted for one of the plurality of support arms, wherein each support area is directly supported by the curb foundation below; and a lower surface on an outer end of each of the plurality of support arms, the lower surface being adapted to rest on a corresponding support area of the mating horizontal joint flange of the lower exhaust hood.

11. The low-pressure steam turbine according to claim 8, wherein each support area of the plurality of support areas comprises an elevated planar surface relative to the horizontal joint flange of the lower exhaust hood, the underside of the support arms disposed upon the elevated planar surface.

12. The low-pressure steam turbine according to claim 11, further comprising:

an expanded cover area of the upper exhaust hood, the expanded cover area adapted to enclose and seal the support area between the upper exhaust hood and lower exhaust hood upon which the outer end of each support arm rests.

13. The low-pressure steam turbine according to claim 8, further comprising:

a plurality of centering arms, one centering arm disposed on each transverse side of the inner casing, wherein an outboard end of the centering arm is fixedly mounted to a centrally disposed fixture on the horizontal casing flange of the lower exhaust hood and the inner end of the centering arm is fixedly mounted to an axial midpoint of the inner casing.

14. The low-pressure steam turbine according to claim 7, the outer end seal further comprising:

a lower half of the outer end seal housing fixedly mounted to the lower exhaust hood;

an upper half of the outer end seal housing attachedly mounted to the upper exhaust hood;

fixed seals within the internal axial cavity of the upper half and the lower half, the fixed seals of the lower half being slidably removable from seal grooves of the lower half of the outer seal end housing; and a first cavity disposed radially between the inner end seal housing and the outer end seal housing and further disposed axially between circumferential buildup rings at an outer end of inner seal housing, and fluidly connected to a source of sealing steam; and a second cavity disposed radially between the inner end seal housing and the outer end seal housing and further disposed axially between circumferential buildup rings inboard axially from the first cavity, and fluidly connected to a vent sink.

15. The low-pressure steam turbine according to claim 7, further comprising:

a journal disposed at least at one end of a shaft of the rotor, wherein the journal is rotatingly supported by a journal bearing mounted within the at least one pedestal standard.

* * * * *